United States Patent [19]

Baumgartner et al.

[11] 4,122,615

[45] Oct. 31, 1978

[54] SMOOTHING IRON SOLE

[76] Inventors: Erich R. Baumgartner, Tiroler Platz 4; Peter Doehler, Kaulbachstr. 59, both of Munich, Fed. Rep. of Germany, 8000

[21] Appl. No.: 786,695

[22] Filed: Apr. 11, 1977

[30] Foreign Application Priority Data

Apr. 13, 1976 [DE] Fed. Rep. of Germany ..... 2616286

[51] Int. Cl.[2] ..... D06F 75/38

[52] U.S. Cl. ..... 38/93; 38/97

[58] Field of Search ..... 38/93, 97

[56] References Cited

U.S. PATENT DOCUMENTS

| | | | |
|---|---|---|---|
| 2,738,603 | 3/1956 | Towne | 38/93 X |
| 2,846,793 | 8/1958 | Studer | 38/93 X |
| 3,905,138 | 9/1975 | Abolafia | 38/97 |

*Primary Examiner*—Patrick D. Lawson

*Attorney, Agent, or Firm*—Griffin, Branigan and Butler

[57] ABSTRACT

A smoothing iron sole includes a sole body comprised at least partly of a glass material. A heating conductor is mounted on a glass-material surface of the sole body facing a sole surface and the sole further includes a thin fabric layer of heat-resistant fibers covering the glass-material surface for defining the sole surface. The heat-resistant fibers are sealed and closed off relative to the heating conductor arrangement by a heat-resistant connecting material which is firmly bonded to the glass-material surface. In one embodiment the heat-resistant fibers are glass fibers and in another they are boron carbide. The connecting material has a melting point which is lower than that of the heat-resistant fibers.

7 Claims, 5 Drawing Figures

SMOOTHING IRON SOLE

DISCUSSION OF PRIOR ART

In the case of a known smoothing iron having a smoothing iron sole made of glass, the heating is effected substantially by radiation acting on the goods being ironed directly through the transparent sole of the smoothing iron. Since glass has a comparatively bad thermal conductivity and high specific heat, the tests made for heating the sole surface of a glass sole body by heat transfer have heretofore not lead to success.

SUMMARY OF THE INVENTION

The object of this invention is to solve the problem of heating the sole surface of a smoothing iron sole consisting at least partly of a glass material so that the surface temperature at the surface facing the goods being ironed can quickly undergo desired temperature variations while a mechanically and electrically resistive surface of the smoothing iron sole is available as the surface facing the goods being ironed.

According to the invention, this problem is solved in that a heating conductor arrangement is provided on a glass material surface of the sole body facing the sole surface and is covered by a thin fabric layer of heat-resistant fibers which is sealed off and closed off relative to the heating conductor arrangement by a heat-resistant connecting material which is also firmly connected to the glass material surface.

The fabric layer of heat-resistant fibers can be a glass fiber fabric layer but is preferably formed of a boron carbide fabric layer. The heat-resistant connecting material is a jacket material of the boron carbide fibers consisting of a comparatively low melting glass. During manufacture of the smoothing iron sole, at elevated temperatures and optionally under a predetermined pressing rate the glass jacket seals off the fabric layer and closes off the same whilst forming a negligibly wavy surface and simultaneously providing a firm connection to the heating conductor arrangement and to the sole support surface located thereunder.

It is apparent that the sole layer formed substantially of the fiber fabric layer may be prepared in a thickness of less than 0.5 millimeters and has quite an extra ordinarily high strength so that the heating conductor arrangement located therebehind is tightly sealed relative to the sole surface both mechanically and electrically.

According to an advantageous further development, the edges of the sole body are at least partially covered by the fabric layer.

BRIEF DESCRIPTION OF THE DRAWINGS

Exemplary embodiments will be elucidated hereinafter in greater detail with reference to the attached drawing in which.

SPECIFICATION OF A PREFERRED EMBODIMENT

Figure 1:
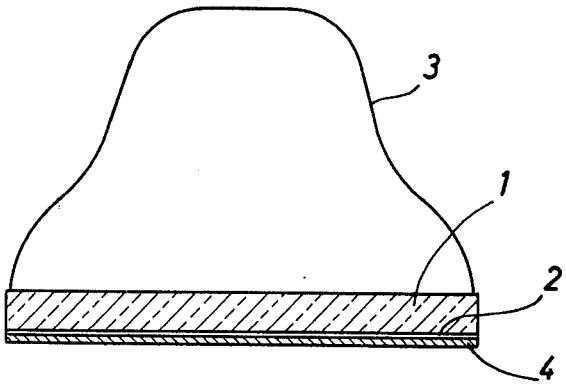
FIG. 1 shows a schematic section through a smoothing iron along with a smoothing iron sole of the type proposed herein, while details regarding the handle construction are omitted.
Figure 2:
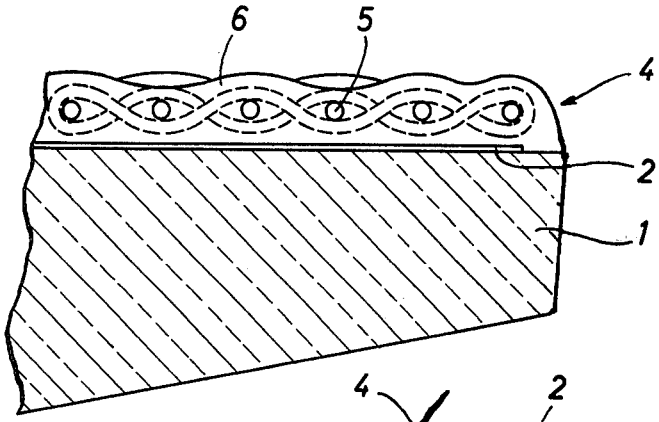
FIG. 2 shows a section through the smoothing iron sole in a greatly enlarged scale in a partial view as well as in a reversed position.

The smoothing iron sole according to FIG. 1 contains a sole support 1 which is made of glass or glass ceramics and, over its side facing the goods being ironed, a thin heating conductor arrangement 2 is provided. The heating conductor arrangement may be formed either from a corresponding foil blank or in a manner such as is generally known in the art for making printed circuits. Connections omitted from FIG. 1 for the sake of clarity extend through openings in the sole body 1 into the interior of the smoothing iron housing 3.

Figure 3:
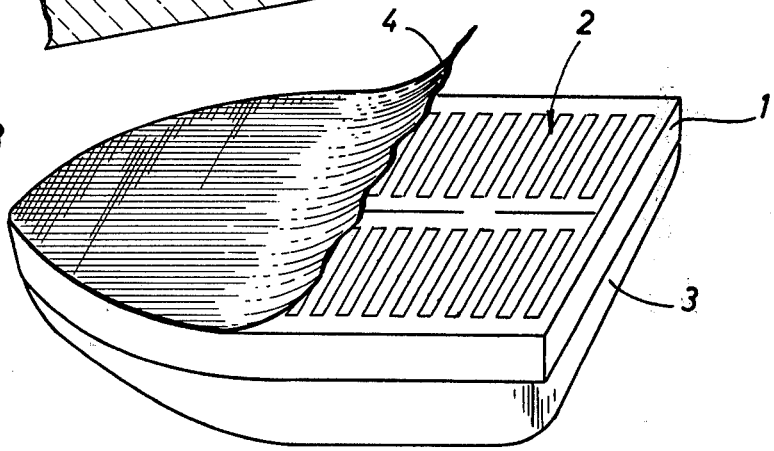
FIG. 3 shows a schematic perspective view of a smoothing iron wherein the sole layer is partly lifted away.

The heating conductor arrangement which, as is shown in FIG. 3, has the shape of a fine meander arrangement, is covered by a sole layer 4 which may have thickness e.g. of less than 0,5 millimeters so that in use of the smoothing iron the heating conductor arrangement 2 is spaced extremely little from the goods being ironed so that the heat stream is directed primarily to the goods being ironed when the heating conductor 2 is coupled to an electric energy source since the sole body 1 consisting of glass or glass ceramics greatly shuts off a heat stream directed to the smoothing iron housing 3.

The sole layer 2 consists of a thin fabric layer of heat-resistant fibers 5 formed of boron carbide fibers or glass fibers the diameter of which is preferably slightly less than half the thickness of the sole layer 4. The fibers 5 of said thin layer of fabric are completely covered by a heat-proof connecting material 6 which also provides the connection to the heating conductor arrangement 2 and to the sole body 1 and simultaneously represents an impregnation of this fabric layer leading to a smooth closed surface of the fabric layer. The connecting material 6 is preferably a relatively low-melting glass or glass solder which, during manufacture, is prepared in the form of a jacket of the heat-resistant fibers from which the thin fabric layer is made to form the sole layer 4.

The manufacture proceedes preferably so that first the heating conductor arrangement 2 is placed over the glass ceramics sole body 1 whereupon the whole arrangement, as shown more or less schematically in FIG. 3, is covered with the thin fabric layer of boron carbide fibers provided with a glass solder jacket. When, upon application of a predetermined pressure and elevated temperatures, the glass solder jacket of the boron carbide fibers is softened and partly melts, all pores of the fabric layer which is simultaneously firmly bonded to the sole body 1 by the glass solder are closed.

It is to be noted here that in certain cases it may be advantageous to provide a layer of fibers extending parallel to each other side-by side instead of a fabric layer. This invention covers this concept too. On the other hand, it may be advantageous to produce a predetermined structure of the sole surface by a predetermined bonding kind of the fabric layer so that the fabric layer may be formed with any other bond and not necessarily with a cloth bond.

Figure 4:
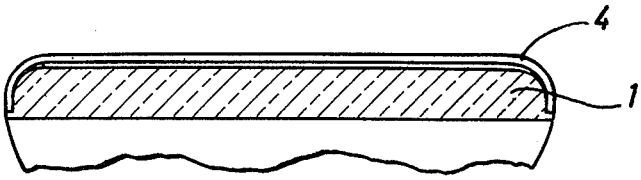
FIG. 4 shows a section through a smoothing iron sole in the inverted position according to a modified embodiment.

FIG. 4 shows that according to a suitable further development the sole layer 4 and/or the fabric layer contained therein is bent around the edges of the sole body 1 whereby the delicate marginal areas of the sole body 1 are protected.

Figure 5:
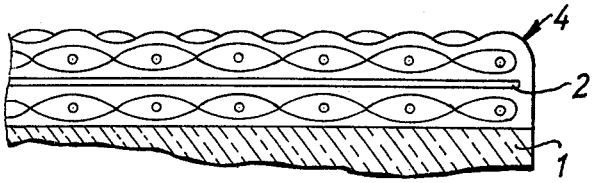
FIG. 5 shows a section through a smoothing iron sole in the inverted position according to a modified embodiment.

According to an embodiment which is shown in FIG. 5, the sole layer 4 may contain more than one fabric layer as well. And it may be suitable to embed the heating conductor arrangement 2 between two such fabric layers so that the heating conductor arrangement 2 is not directly adjacent the sole body 1 but is separated from the sole body 1, on the one hand, and from the sole surface coming into touch with the goods being ironed on the other hand by a fabric layer impregnated with a heat-resistant connecting material, in particular impregnated with glass.

As already mentioned hereinabove, the sole surface must not be necessarily as smooth as a mirror. Rather it may be advantageous when the same has undulations or bulges corresponding to the bond of the fabric layer.

Summarizing, it is to be noted that the sole layer which is practically formed of a glass-impregnated fabric layer of heat-proof glass or boron carbide fibers has a mechanical strength which is several times greater than that of a glass layer or glaze of the same thickness.

What is claimed is:

1. A smoothing iron sole defining a sole surface, said sole having a sole body comprised at least partly of a glass material, and comprising a heating conductor arrangement mounted on a glass-material surface of the sole body facing the sole surface, said sole further comprising a thin fabric layer of heat-resistant fibers covering said glass-material surface for defining said sole surface said heat resistant fibers being sealed and closed off relative to the heating conductor arrangement by a heat-resistant connecting material which is also firmly bonded to the glass material surface.

2. The smoothing iron sole according to claim 1, wherein the heat-resistant fibers are glass fibers.

3. The smoothing iron sole according to claim 1, wherein the heat-resistant fibers are boron carbide fibers.

4. The smoothing iron sole according to claim 1, wherein the connecting material has a melting point which is lower than that of the heat-resistant fibers.

5. The smoothing iron sole according to claim 4, wherein the connecting material is a glass jacket for the heat-resistant fibers.

6. The smoothing iron sole according to claim 1 wherein the thin fabric layer of heat-resistant fibers and the heat-resistant connecting material encroaches the edges of the sole body.

7. The smoothing iron sole according to claim 1 wherein also between the heating conductor arrangement and the sole body, there is provided a thin fabric layer of heat-resistant fibers which is impregnated with heat-resistant bonding material.

* * * * *